US006480220B1

(12) United States Patent
Tamaki

(10) Patent No.: US 6,480,220 B1
(45) Date of Patent: Nov. 12, 2002

(54) IMAGE RECORDER AND OPTICAL FIBER ARRAY UNIT

(75) Inventor: Eiichi Tamaki, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 0 days.

(21) Appl. No.: 09/433,720

(22) Filed: Nov. 4, 1999

(30) Foreign Application Priority Data

Nov. 6, 1998 (JP) ..... 10-315838

(51) Int. Cl.[7] ..... B41J 15/14; B41J 27/00
(52) U.S. Cl. ..... 347/242; 347/241
(58) Field of Search ..... 347/242, 244, 347/238, 241; 385/116, 83, 65, 115; 358/484

(56) References Cited

U.S. PATENT DOCUMENTS 4,046,454 A * 9/1977 Pugh, III ..... 385/65 X
4,096,486 A * 6/1978 Pfeifer et al. ..... 347/238
4,389,655 A * 6/1983 Baues ..... 347/241
4,918,465 A * 4/1990 Morita ..... 347/232
4,991,930 A 2/1991 Baek et al.
5,009,475 A * 4/1991 Knudson ..... 385/116
5,212,500 A * 5/1993 Harrigan et al. ..... 347/241
5,321,426 A 6/1994 Baek et al.
5,477,259 A * 12/1995 Iwasa ..... 347/238

FOREIGN PATENT DOCUMENTS

EP 0 945 276 A1 * 9/1999 ..... B41J/2/44
JP 57188003 A * 11/1982 ..... 385/115
JP 02093406 A * 4/1990 ..... 385/115
WO WO-98/42516 A1 * 10/1998 ..... B41J/2/44

* cited by examiner

*Primary Examiner*—Hai Pham
(74) *Attorney, Agent, or Firm*—McDermott, Will & Emery

(57) ABSTRACT

Optical fibers are arranged into staggered matrix. Spacer substrates are inserted between rows of the staggered matrix and cover substrates are attached on the top and bottom of the staggered matrix. All fibers are arranged at a constant pitch P/N in a subscanning direction Y without any overlapping therebetween, where the number P is the pitch of the optical fibers in each row and is the number of the staggered matrix. Photo-beams modulated in response to image signals are emitted from light-emitting ends of the optical fibers onto an objective surface. The spacer substrates reduce the arrangement pitch of the optical fibers in the direction Y, facilitating fine image recording.

8 Claims, 11 Drawing Sheets

"M" DENOTES "M-FIBERS"

(PRIOR ART)

IMAGE RECORDER AND OPTICAL FIBER ARRAY UNIT

BACKGROUND OF THE INVENTION

1. Field of the Invention

The present invention relates to an image recorder for emitting photo-beams onto an objective surface to record an image on the objective surface, and more particularly, it relates to an improvement in an optical fiber array unit adapted to the image recorder.

2. Description of the Background Art

An optical fiber array having a bundle of optical fibers is used in an image recorder for high density image-recording. The fiber array is advantageous in that the spatial intervals of light emission points are reduced to the diameter of, each fiber, i.e., 0.125 mm to 1.0 mm. However, the clads in respective fiber ends do not contribute light emission and blank areas corresponding to the clads appear on the recorded image, so that the density of scanning lines is reduced on an image-recording medium.

U.S. Pat. No. 4,991,930 discloses an improved fiber array as illustrated in FIG. 9A. A plurality of fiber rows 901–903 are stacked into a staggered arrangement with an alternate half-pitch deviations to increase the recording density.

U.S. Pat. No. 5,321,426 discloses an inclined arrangement of a single fiber row as illustrated in FIG. 9B to prevent the undesirable blanks between scanning lines.

In the former prior art, U.S. Pat. No. 4,991,930, the position of the first fiber row 901 is fixed by V-shaped grooves while respective fiber positions of the second fiber row 902 are fixed between the fibers of the first fiber array 902. The half-pitch deviations between the first and second rows 901, 902 contributes the improvement of the recording density. However, the third row 903 is aligned just above the first row 901 and the recording density is not further increased by the third row 903. The improvement of the recording density is limited to twice the conventional one.

On the other hand, the arrangement of the latter prior art, U.S. Pat. No. 5,321,426 is effective to further increase the recording density. However, a wide array of fibers is required to further improve the recording density because the fiber array is sinble and linear. The wide array of the fibers increases an imaging field and it requires a lens system having large aperture, which causes a problem of aberration. Further, when the photo-beams are emitted onto a recording medium wound around a rotary drum, the focal points of respective photo-spots are hardly coincident with the curved surface of the recording medium, since the distances from the respective fiber ends to the curved surface of the recording medium are not substantially constant between the center part and both end parts of the wide fiber array.

SUMMARY OF THE INVENTION

The present invention is directed to an image recorder for scanning an objective surface with a plurality of photo-beams in main scanning direction and a subscanning direction to record an image on the objective surface.

According to the present invention, the image recorder comprises: a light source for generating light; an optical fiber array unit comprising a plurality of optical fibers arranged into a plurality of optical fiber rows for receiving the light and emitting a plurality of photo-beams, and at least one spacer substrate inserted between the plurality of the optical fiber rows, the spacer substrate having top holding means, formed on a top surface thereof, for holding ones of the optical fiber rows and bottom holding means, formed on a bottom surface thereof, for holding other ones of the optical fiber rows; and an optical system for transmitting the plurality of photo-beams from the optical fiber array unit onto the objective surface.

The top holding means is formed in parallel with the bottom holding means, and both the holding means are staggered in the subscanning direction.

In an aspect of the present invention, a plurality of spacer substrates are provided in the optical fiber array unit, and the plurality of spacer substrates are stacked such that the holding means of one spacer substrate fits in with the bottom holding means of another spacer substrate.

In a preferred embodiment of the present invention, the plurality of optical fiber rows are staggered in the subscanning direction by integer times of the amount P/N, where P is a fiber arrangement pitch of in each optical fiber row, and N is the number of optical fiber rows included in the optical fiber array unit.

Preferably, the optical fiber array unit further comprises a first cover substrate provided above a top spacer substrate among the plurality of the spacer substrates and having holding means fitting in with the top holding means of the top spacer substrate, and a second cover substrate provided below a bottom spacer substrate among the plurality of the spacer substrates and having holding means fitting in with the bottom holding means of the bottom spacer substrate.

Only one fiber row may be held in each tunnel space, or two rows may be held in each tunnel space.

In a preferred embodiment of the present invention, the top and bottom holding means comprise a plurality of grooves arranged in the subscanning direction.

In another aspect of the present invention, an image recorder comprises a light generator for generating a plurality of lights modulated by image signals; a plurality of flexible linear optical guides for transmitting the plurality of lights to an objective surface and having each light-emitting end arranged on a staggered matrix without positional overlapping of the light-emitting end in a row direction; and at least one spacer inserted between any row of the staggered matrix.

The present invention also provide a fiber array unit usable in the image recorder.

Accordingly, an object of the present invention is to increase a recording density to attain a fine image recording without increasing an imaging field of photo-beams emitted form an optical fiber array unit.

Another object of the present invention is to obtain a rigid structure of an optical fiber array unit in which respective fiber are well-positioned.

Further another object of the present invention is to obtain a rigid structure of an optical fiber array unit in which respective fiber are well-positioned.

Further another object of the present invention is to attain a fine image recording without increasing costs.

These and other objects, features, aspects and advantages of the present invention will become more apparent from the following detailed description of the present invention when taken in conjunction with the accompanying drawings.

DESCRIPTION OF PREFERRED EMBODIMENTS

<System>

Figure 1A:
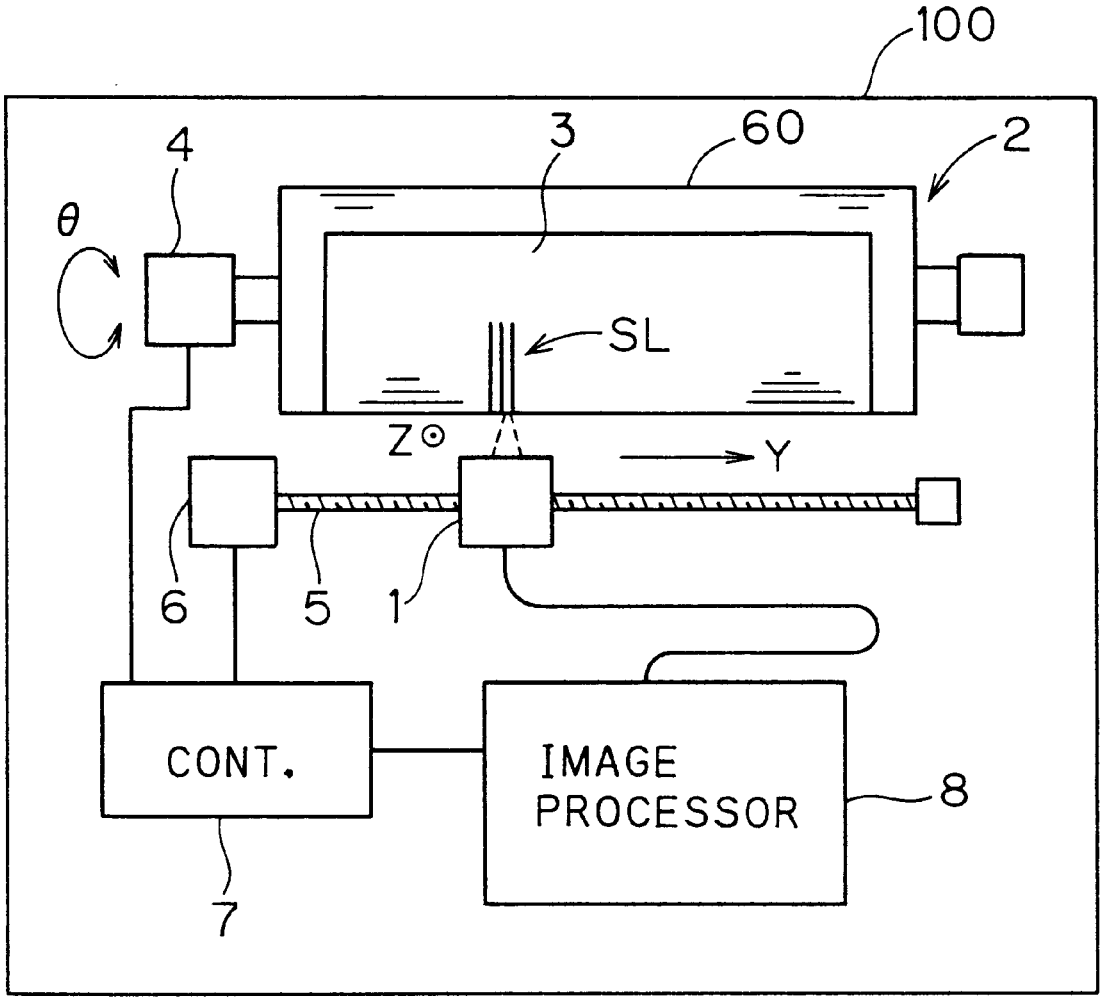
FIG. 1A illustrates an image recorder according to a preferred embodiment of the present invention.

FIG. 1A illustrates an image recorder 100 according to a preferred embodiment of the present invention, in which optical fibers or flexible linear optical guides are used for transmitting photo-beams.

The rotary drum system 2 comprises a drum 60 on which a photo-sensitive recording medium 3 is wound. The drum 60 is rotated in the direction θ by means of an electric motor 4. A recording head 1 faces to the recording medium 3 and is linearly moved in a direction Y along a screw bar 5 rotated by another electric motor 6. The motors 4 and 6 are controlled by a controller 7. The recording medium 3 may be a thermal print medium, in which a dye is transferred by sublimation from a donor to a receiver as a result of selectively heating the dye in the donor by photo-beams. In this case, the image recorder 100 is served as a thermal image recorder or a thermal printer. Alternatively, the recording medium 3 is a photosensitive medium for producing a latent image thereon. Further, the drum 60 itself may be photo-sensitive drum as in an electric photography or a digital copy machine, which is operable without a separate photosensitive medium. In other words, an objective surface on which an image is to be recorded may be a recording medium wound around the drum or may be the drum surface itself.

A image processor 8 generates image signals and transmits the image signals to the recording head 1. The recording head 1 generates photo-beams modulated by the image signals and emitting the photo-beams onto the recording medium 3. The rotation of the drum 60 causes a main scanning of the recording medium 3 in the, direction Z, which is the tangential direction of a temporary target area of the drum 60 onto which the photo-beams are just emitted, while the linear movement of the recording head 1 defines a subscanning in the direction Y. Scanning lines SL are defined along the circumferential direction of the drum 60 by traces of the photo-beams. Respective scanning lines SL are substantially parallel with each other, and are in parallel with the main scanning direction Z at the temporary target area of the drum 60.

<Recording Head>

Figure 1B:
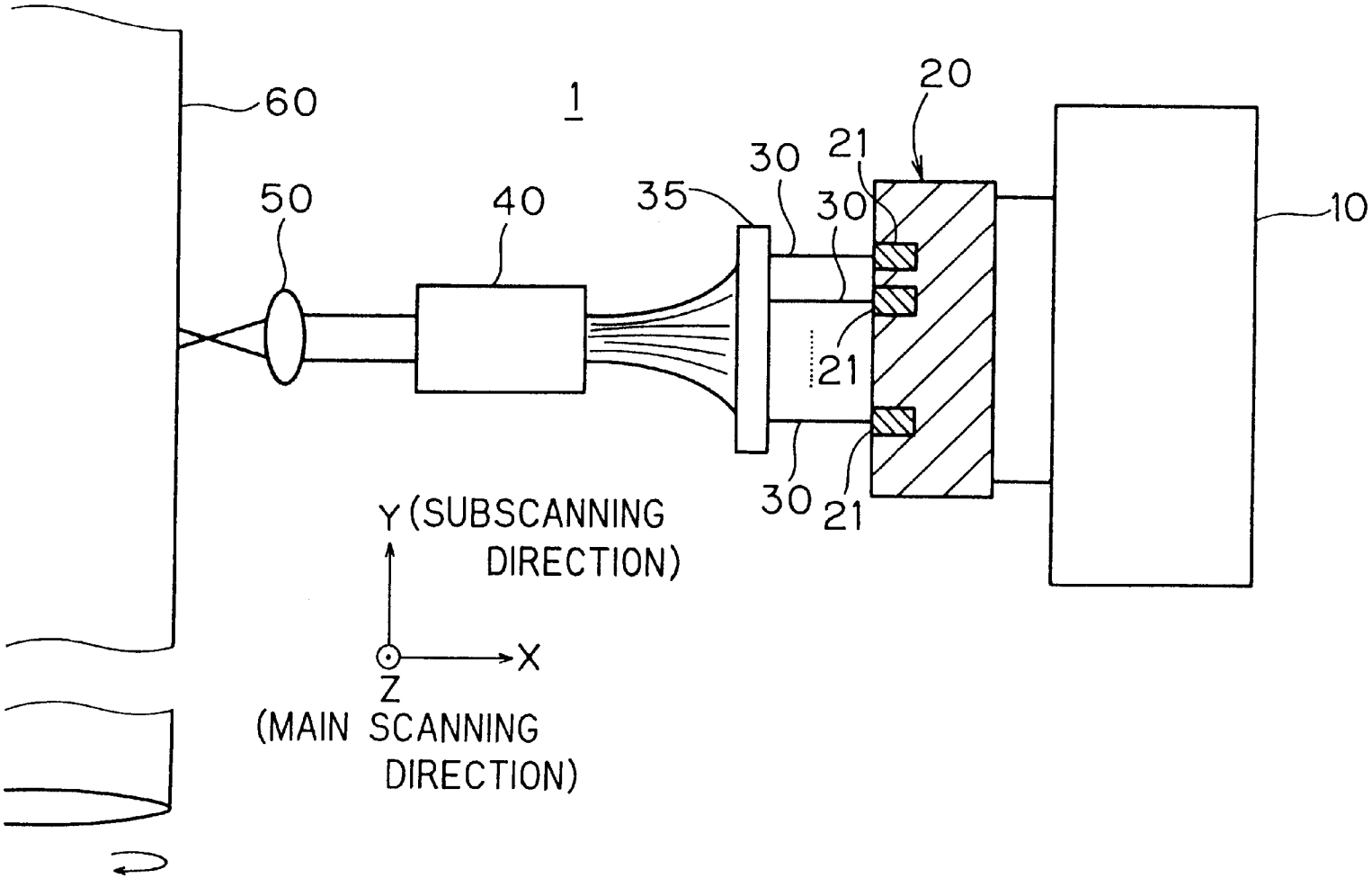
FIG. 1B depicts an arrangement of a recording head and an objective surface in the image recorder.

As illustrated in FIG. 1B, the optical head 1 comprises a laser driver 10 for driving a light source 20, a fiber array unit 40 holding respective end parts of optical fibers 30, and an optical system 50 facing to the objective surface on the drum 60.

The light source 20 comprises a plurality of semiconductor lasers or laser diodes (LD's) 21 capable to emit laser lights or photo-beams when electric power is supplied from the laser driver 10. Respective light receiving ends of the optical fibers 30 are optically coupled with the semiconductor lasers 21. The optical fibers 30 are bundled up through a connector 35 and respective light emitting ends of the optical fibers 30 are fixed in the optical fiber array unit 40.

Photo-beams emitted form the semiconductor lasers 21 are transmitted through the optical fibers 30 and emitted from the respective light emitting ends held in the optical fiber array unit 40. The photo-beams emitted from the optical fiber array unit 40 are focused onto the objective surface on the drum 60 through the lens system 50.

<Optical Fiber Array Unit of First Embodiment>

Figure 2A:
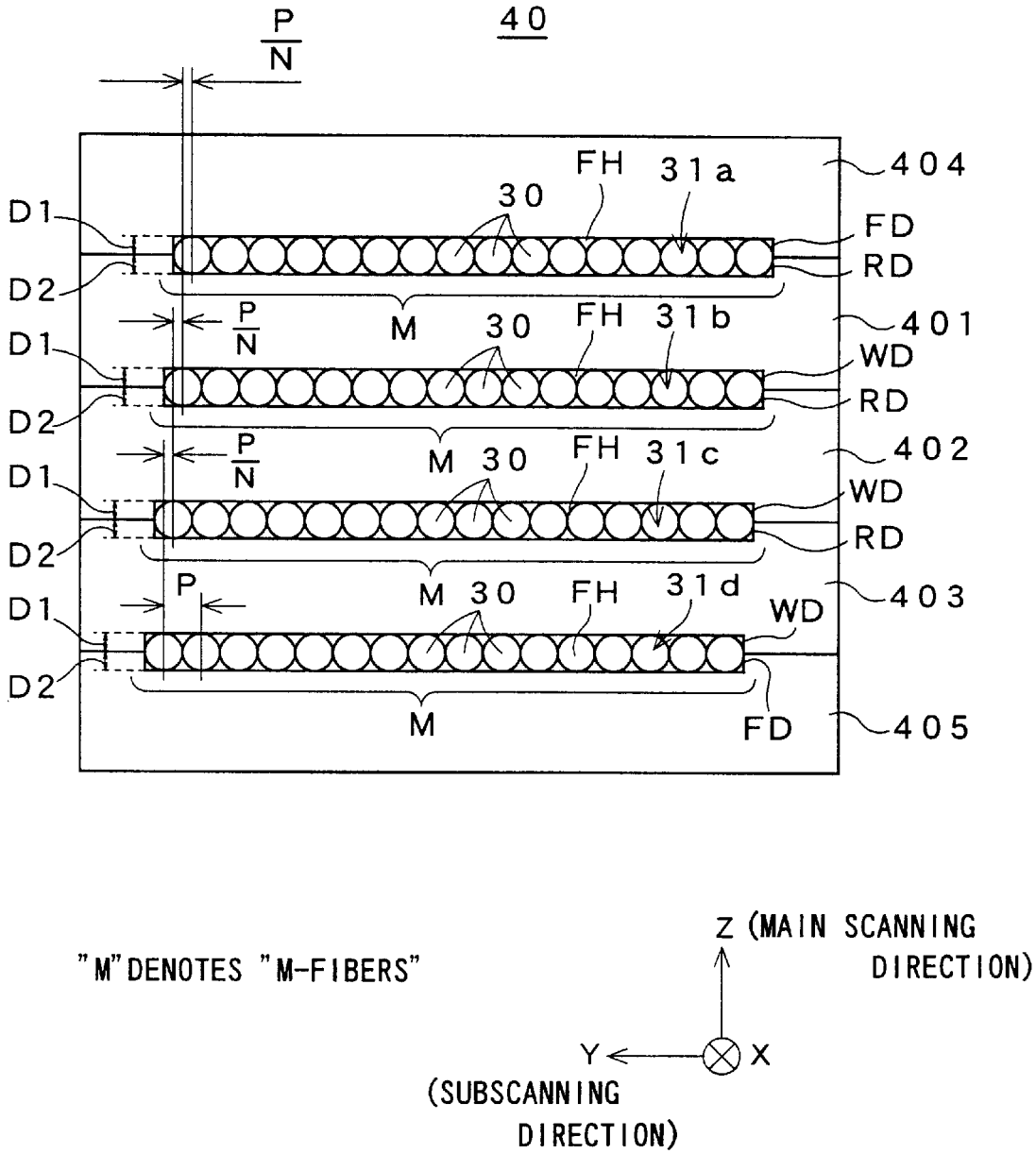
FIGS. 2A illustrates the ends of an optical fiber array unit according to first preferred embodiment of the present invention.

FIG. 2A depicts a light emitting end of the optical fiber array unit 40 according to first preferred embodiment of the present invention. The optical fiber array unit 40 is provided with a parallel arrangement of optical fiber rows 31*a*, 31*b*, 31*c* and 31*d* each consisting of a linear array of the optical fibers 30. Spacer substrates 401, 402 and 403 are inserted between the optical fiber rows 31*a*, 31*b*, 31*c* and 31*d* to fix and hold the positions of the optical fiber rows 31*a*–31*d*. Cover substrates 404 and 405 are provided at the top and bottom of the optical fiber array unit 40 to fix the positions of the top fiber row 31*a* and the bottom fiber row 31*d*, respectively. That is, the optical fiber rows 31*a*–31*d* and the substrates 404, 401–403, 405 are alternatively stacked in the direction Z, so that the optical fiber rows 31*a*–31*d* are supported or guided by the substrates 404, 401 403, 405. Respective right and left side edges of the substrates 401–405 are aligned, whereby the side walls of the optical fiber array unit 40 are straight surfaces. The cover substrates 404 and 405 may be pressed to clamp the optical fiber rows 31*a*–31*d* between the stack of the substrates 401–405.

Each of the spacer substrates 401–403 is provided with a top channel RD and a bottom channel WD on the top and bottom surfaces thereof, respectively, each channel serving as a structure for fixing the positions of the optical fibers 30. The top and bottom channels RD and WD have respective width in the direction Y and extend in parallel with the direction X penetrating the drawing plane of FIG. 2A. In addition, each of the cover substrates 404 and 405 has a channel FD extending in parallel with the direction X. All the channels RD, WD and FD are shallow concavities having flat floors or ceilings.

The bottom channel FD of the cover substrate 404 fits in with the top channel RD of the first spacer substrate 401 to form a first fiber-fixing hole PH containing the first fiber row 31*a*, while the bottom channel WD of the first (second) substrate 401 (402) fits in with the top channel RD of the second (third) spacer substrate 402 (403) to form the second (third) fiber-fixing hole FH containing the second (third) fiber row 31*b* (31*c*). the bottom channel WD of the third spacer substrate 403 fits in with the top channel FD of the cover spacer substrate 405 to form the fourth fiber-fixing hole FH.

The quantities P, N and M shown in FIG. 2A are defined as follows:

P: This is the pitch or periodical interval of the optical fibers 30 in each optical fiber row 31*a*–31*d*. The optical fibers 30 are closely packed in each fiber-fixing hole FH, so that the pitch P is substantially equal to the diameter of each optical fiber 30.

N: This is the number of the optical fiber rows 31*a*–31*d* and is four (N=4) in the example illustrated in FIG. 2A.

M: This is the number of the optical fibers 30 in each fiber row 31*a*–31*d* and is sixteen (M=16) in the example illustrated.

In FIG. 2A, respective channels RD, WD and FD have a common width (M×P) in the direction Y in which the optical fibers 30 are arrayed in each fiber row 31*a*–31*d*.

The respective fiber-fixing holes FH are in parallel with the direction X and have the common width (M×P) in the direction Y but their locations are deviated step by step in the subscanning direction Y, where the direction X is defined as the direction substantially perpendicular to respective scanning directions Z and Y. The respective bottom banks of the substrates 404, 401–403 are bonded to the top banks of the substrates 401–403, 405, respectively, and the optical fibers 30 are fixed in respective fiber-fixing holes FH. That is, the respective fiber-fixing holes FH are. tunnel spaces or slit holes extending in the direction X and have the common width (M×P) in the direction Y.

The depth D1 of the ceiling channel and the depth D2 of the floor channel in each fiber-fixing hole or tunnel space FH are determined such that the sum of the depth D1 and D2, which is the height of each fiber-fixing hole FH in the direction Z, coincides with the diameter P of each optical fiber 30, i.e., D1+D2=P.

When the M optical fibers 30 are inserted into each fiber-fixing hole FH, there are no gaps between the M optical fibers (M-lines of optical fibers) 30 and also between the optical fibers 30 and the floor, the ceiling, both side walls of the fiber-fixing hole FH. The channels RD, WD and FD restrict the positions of the M optical fibers 30 to define the optical fiber rows 31*a*–31*d* fixed or tightly bundled in both directions Y and Z in the fiber-fixing holes FH.

The top channel RD and the bottom channel WD of each spacer substrate 401–403 are deviated by the length P/N in the cross-channel direction equivalent to the subscanning direction Y, and the bottom channel WD of the upper spacer substrate 401 (402) fits in with the top channel RD of each spacer substrate 402 (403) in their sizes and positions. Respective adjacent spacer substrates 401, 402 (402, 403) are bonded to each other at respective banks of channels to form the fiber-fixing holes FH. As a result, the fiber-fixing holes FH are sequentially deviated in their Y-positions by the length P/N when observed from the upper one to the lower one, and accordingly, the respective Y-positions of the M optical fibers 30 are also sequentially deviated by the length P/N between the optical fiber rows 31*a*–31*d*.

Figure 2B:
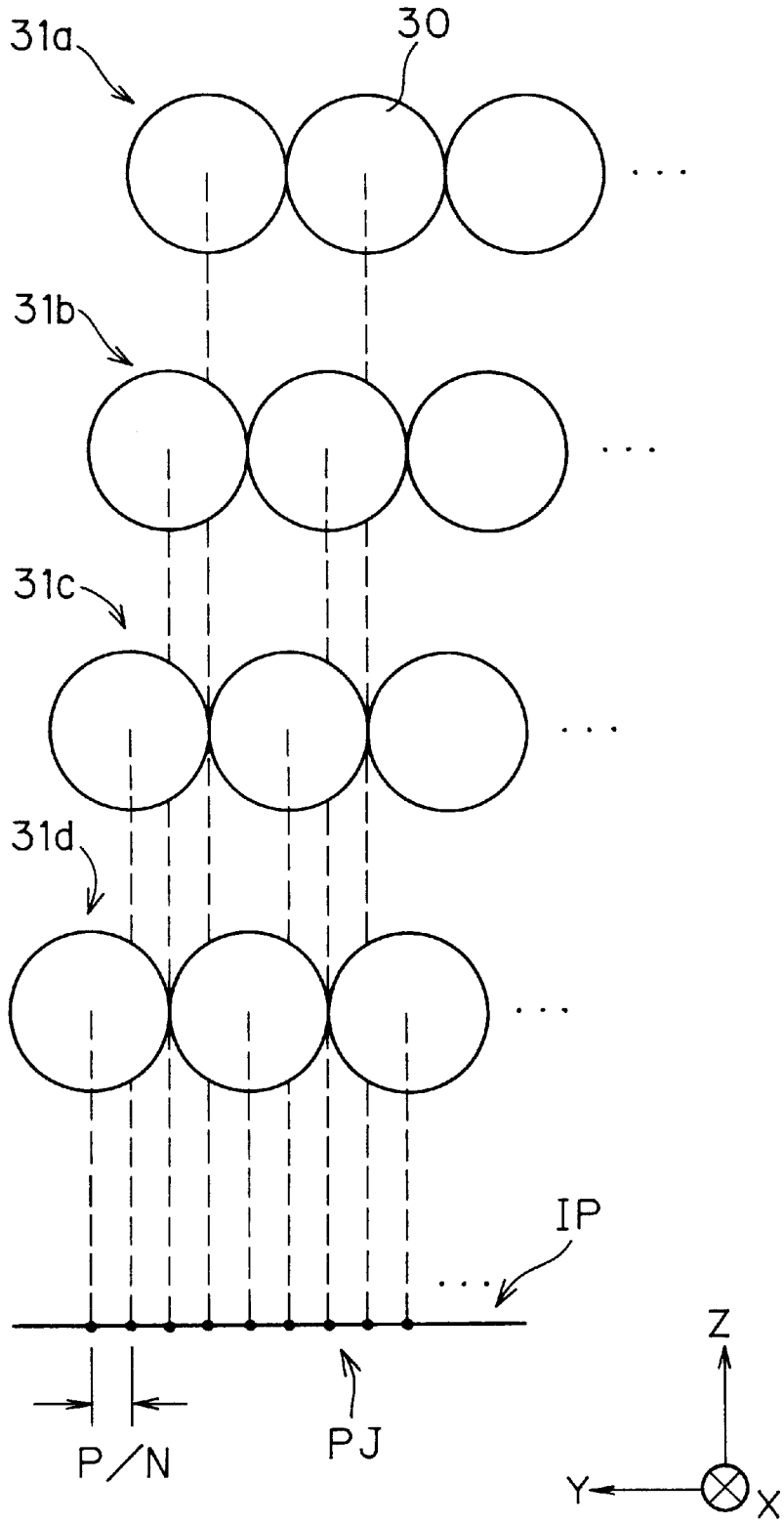
FIGS. 2B illustrates projections of respective fiber positions.

When the respective positions of all optical fibers (M×N lines, of fibers) 30 are projected in the direction Z onto an imaginary X-Y plane IP (FIG. 2B) and M×N fiber projections PJ are defined, the M×N fiber projections PJ perfectly separate on the imaginary plane IP with the gap P/N therebetween and there are no overlaps between any two of the fiber projections PJ. The fiber projections PJ forms a periodical linear array consisting of the positions corresponding to the M×N optical fibers 30, the periodical array having the pitch P/N. When the drum 60 is rotated in the inverse (−Z) of the main scanning direction Z while the optical fibers 30 are selectively enabled to emit photo-beams toward the drum 60, M×N scanning lines having the pitch P/N are defined in parallel on the objective surface of the drum 60. The width of the optical fiber array consisting of the M×N optical fibers according to the preferred embodiment is about P×(M+1) and is not so larger than the width of each fiber row P×M. Thus, the optical fiber array unit 40 can emit photo-beams at high density, which density is M times as compared with an optical fiber array unit having a single fiber row only.

As shown in FIG. 2A, the optical fiber rows 31*a*–31*d* are stacked up at positions sequentially deviated by P/N in the subscanning direction, and the respective ends of the optical fibers are two-dimensionally arrayed to form a multi-row steps. Thus, it is prevented to increase the imaging field when high density image recording is conducted.

<Optical Fiber Array Unit of Second Embodiment>

Figure 3:
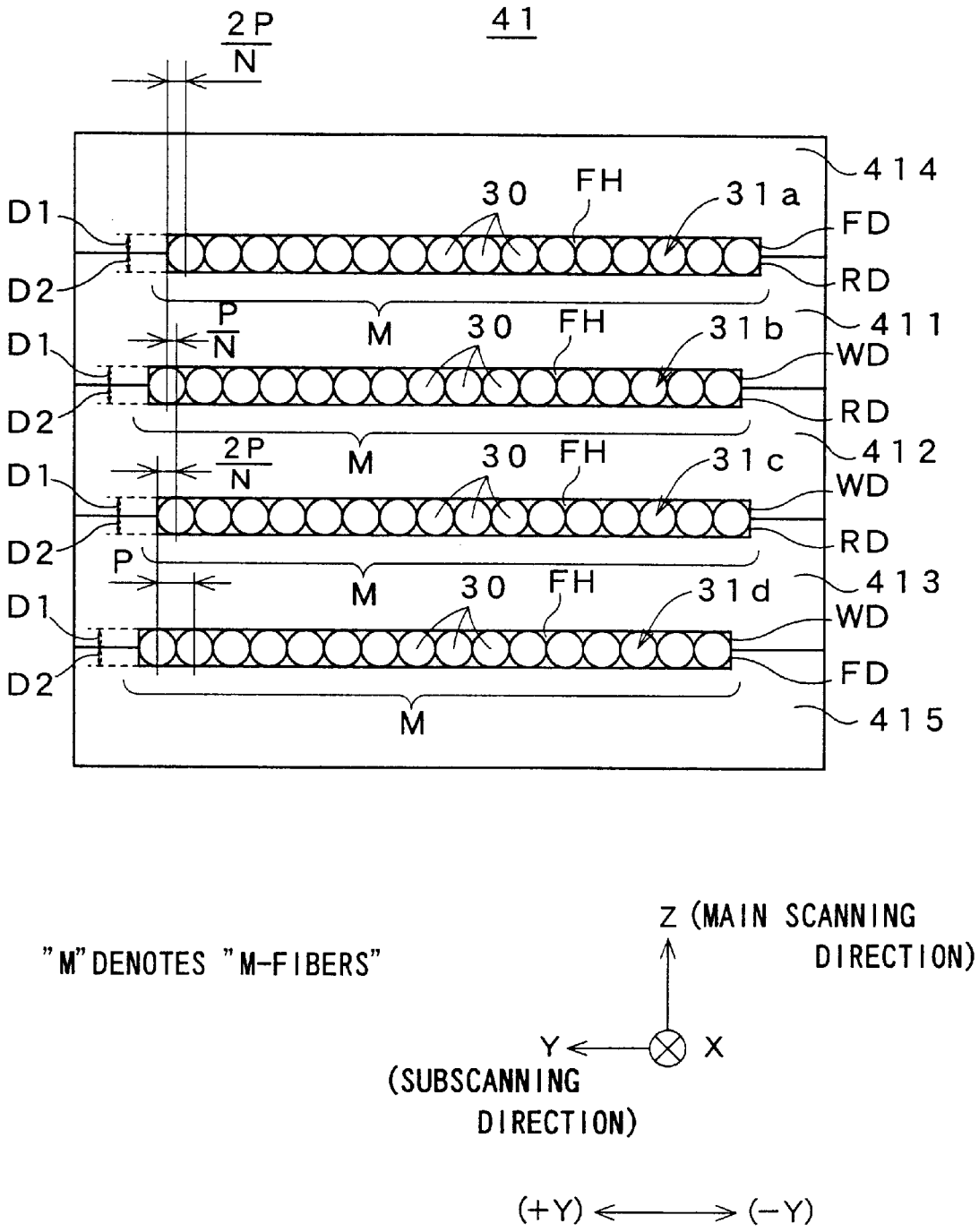
FIGS. 3 through 8 illustrate the ends of an optical fiber array unit according to second to seventh preferred embodiments of the present invention, respectively.

An image recorder according to a second preferred embodiment of the present invention is similar to the image recorder of the first preferred embodiment and only difference is in that an optical fiber array unit 41, whose light emitting end is shown in FIG. 3, is used in place of the optical fiber array unit 40.

The parallel arrangement of the optical fiber rows 31*a*–31*d* in the optical fiber array unit 41 is such that:

the second optical fiber row 31*c* is deviated from the first (bottom) fiber row 31*d* in the negative direction (−Y) by the amount of 2P/N;

the third optical fiber row 31*b* is deviated from the second fiber row 31*c* in the positive direction (+Y) by the amount of P/N; and the fourth (top) optical fiber row 31*a* is deviated from the third optical fiber row 31*b* in the negative direction (−Y) by the amount of 2P/N.

The respective deviations of the second to fourth optical fiber rows 31*c*, 31*b*, 31*a* from the first optical fiber row 31*d* are 2P/N, P/N, 3P/N in the negative direction (−Y), respectively. When the respective fibers 30 are projected in the main scanning direction onto an imaginary X-Y plane, the M×N fiber projections perfectly separate on the imaginary plane with the gap P/N therebetween and there are no overlaps between any two of the fiber projections, the situation being similar to the arrangements of the projections PJ in FIG. 2B. The optical fiber array unit 41 can be uses to scan the objective surface with the M×N photo-beams with the pitch P/N. The channels RD and WD in the spacer substrates 411, 412, 413 are mutually deviated from each other in the cross-channel direction equivalent to the subscanning direction Y. which may be positive (+Y) or negative (−Y), by the distances corresponding to integer times of P/N, i.e., (+P/N, +2P/N), or (−P/N, −2P/N).

In general, the order of stacks of the optical fiber rows in the direction Z is arbitrary for the high density image recording as long as the projections of all optical fibers 30 in the main scanning direction Z onto the imaginary X-Y plane satisfy the condition that only one projection (fiber) is present at each position (i×P/N ) for i=1, 2, 3, . . . (N−1) from a reference projection which is one of end projections (the left end projection, for example). The reference projection may be the projection of the optical fiber located at the left end of the bottom fiber row 31*d*, for example.

The condition can be also expressed by respective row positions rather than the positions of individual fibers. That is, the respective deviations of the n-th optical fiber rows (n=1, 2, 3, 4, . . . , N) from a predetermined reference row position may be in the basic order:

(0, P/N, 2P/N, 3P/N, . . . , (N−1)/P)

or one of all possible permutations of the basic order. The reference row position is the position of the row 31*d* in the example of FIGS. 2A and 3. The all possible permutations of the basic order are:

(0, 2P/N, P/N, 3P/N, . . . , (N−1)/P);

(0, 1P/N, 3P/N, 2P/N, . . . , (N−1)/P);

(0, 3P/N, 2P/N, P/N, . . . , (N−1)/P);

. . .

((N−1)/P, . . . , 3P/N, 2P/N, P/N, 0)

For example, when N=4, the basic order is:

case 1: (0, P/N, 2P/N, 3P/N)=(0, P/3, 2P/3, 3P/3);

and the all possible permutations of the basic order are:

case 2: (0, P/N, 3P/N, 2P/N)=(0, P/3, 3P3, 2P/3)

case 3: (0, 2P/N, P/N, 3P/N)=(0, 2P/3, P/3, 3P/3);

case 4: (0, 2P/N, 3P/N, P/N)=(0, 2P/3, 3P/3, P/3);

case 5: (0, 3P/N, P/N, 2P/N)=(0, 3P/3, P/3, 2P/3); and case 6: (0, 3P/N, 2P/N, P/N)=(0, 3P/3, 2P/3, P/3)

. . .

case 24: (3P/N, 2P/N, P/N, 0)=(3P/3, 2P/3, P/3, 0)

The first preferred embodiment of FIG. 2A corresponds to the "case 1", while the second embodiment of FIG. 3 for corresponds to the "case 3". The deviations may be positive or negative depending on the definition of the plus and minus signs of the direction Y. The respective light-emitting ends of the optical fibers 30 of case 1 and case 6 are distributed as an inclined matrix (FIG. 2A) and those of cases 2–5 are distributed as a staggered matrix (FIG. 3 etc.).

In other words, since the deviations between the projections reflect the deviations between the optical fiber rows in the direction Y, the condition is equivalent to the following condition of relative deviations among the optical rows.

That is, when an optical fiber row which is included in all fiber rows and is located at a reference row position is defined as a reference row, deviations of all optical fiber rows from the reference row in the direction Y are:

(0, P/N, 2P/N, 3P/N, . . . , (N−1)/P) . . . basic order or one of all permutations of elements in the basic order.

The reference row is the fiber row having the deviation "0" and the deviations of the other rows are measured from the position of the reference row.

<Optical Fiber Array Unit of Third Embodiment>

Figure 4:
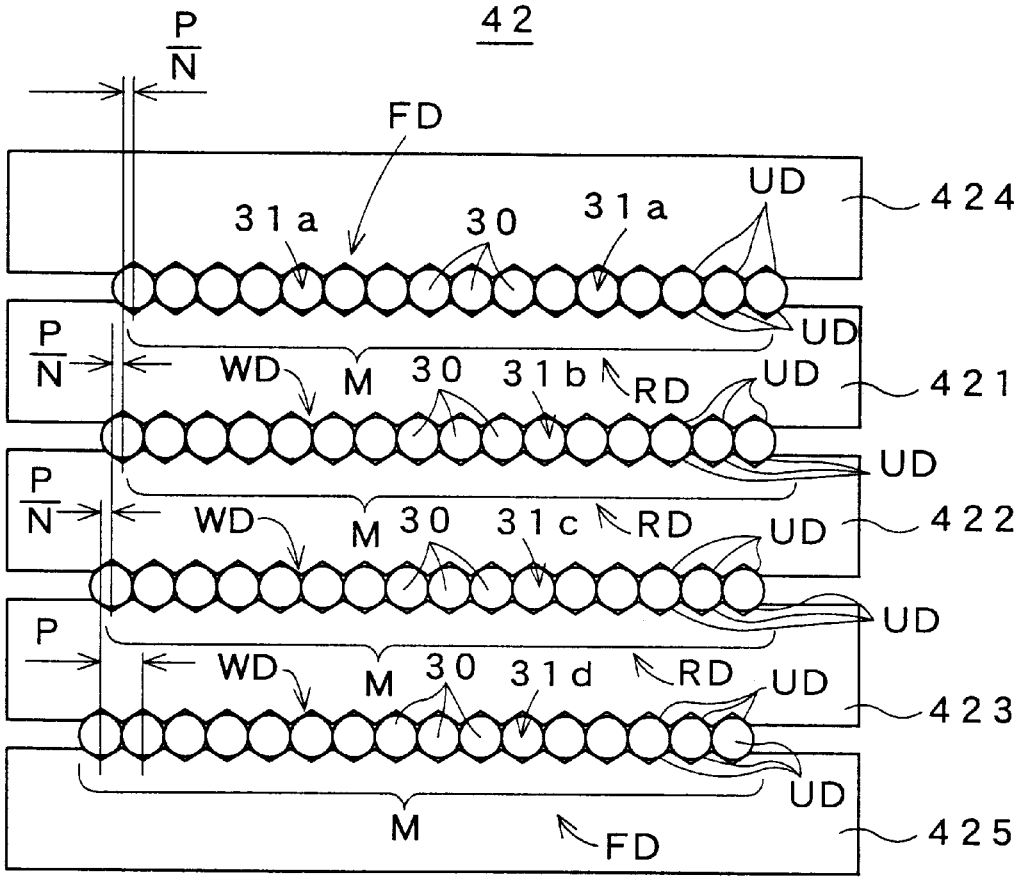
Figure 4:
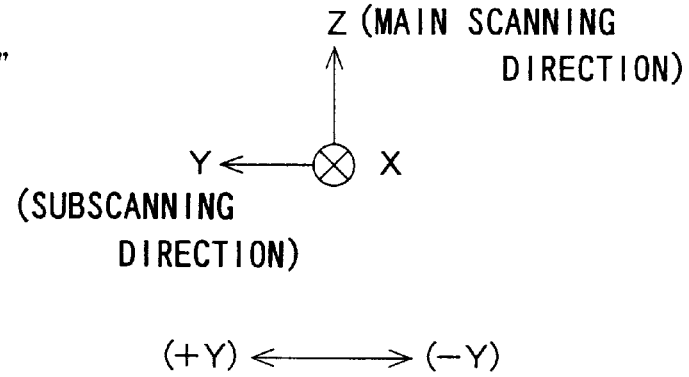

An image recorder according to a third preferred embodiment of the present invention is similar to the image recorder of the first preferred embodiment and only difference is in that an optical fiber array unit 42, whose light emitting end is shown in FIG. 4, is used in place of the optical fiber array unit 40.

As already described, each of the substrates 401–405 in the optical fiber array unit 40 of the first preferred embodiment (FIG. 2A) is provided with the channels RD and WD or the channel FD for supporting the optical fiber rows 31*a*–31*d* of the optical fibers 30 without internal structures of the channels. The optical fiber array unit 42 of the third preferred embodiment has spacer substrates 421–423 having a top channel WD and a bottom channel RD and cover substrates 424, 425 having a channel FD, wherein each channel WD, RD, FD has an internal structure consisting of a plurality of unit grooves UD. In each channel, the number of the unit grooves UD coincides with the number M of the optical fibers 30 included in each optical fiber rows 31*a*–31*d*. Each unit groove UD extends in the direction X, and the sixteen unit grooves UD of each channel WD, RD, FD form a parallel and periodic arrangement covering each optical fiber row 31*a*–31*d* and having an arrangement pitch P corresponding to the diameter of each optical fiber 30.

The cross section of each unit groove UD is V-shaped in the Y-Z plane and the M unit grooves UD form each channel WD, RD, FD, whereby the saw-like or gear teeth like wave is defined in each channel WD, RD, FD of substrate 421–425.

The respective optical fibers 30 of each fiber row 31*a*–31*d* are inserted into the unit grooves UD of the channels RD, WD, FD to be positioned in the direction Y Each optical fiber 30 is clamped between two unit grooves facing to each other among the channels RD, WD, FD, to be positioned in the direction Z without direct contacts between neighboring two of the spacer substrates (423, 422), (422, 421). The clamp is also attained between the top and bottom cover substrates and neighboring spacer substrates (425, 423), (421, 424).

The top channels RD and the bottom channels WD of the spacer substrates 421–423 and the channels FD of the cover substrates 424, 425 are sequentially deviated in the direction Y with the pitch P/N. The positional relationship between the optical fiber rows 31*a*–31*d* is similar to that of the first preferred embodiment. The projections of all fibers 30 in the main scanning direction Z are M×N lines periodically arranged with a pitch P/N, to ensure a parallel scanning with M×N photo-beams.

The image recorder according to the third preferred embodiment is advantageous in that image recording is conducted at a high-density as in the first and second preferred embodiments and, in addition, the accuracy in positioning the optical fibers 30 is further improved and fine scanning is attained because they are fixed by the V-shape of the unit grooves UD.

<Optical Fiber Array Unit of Fourth Embodiment>

Figure 5:
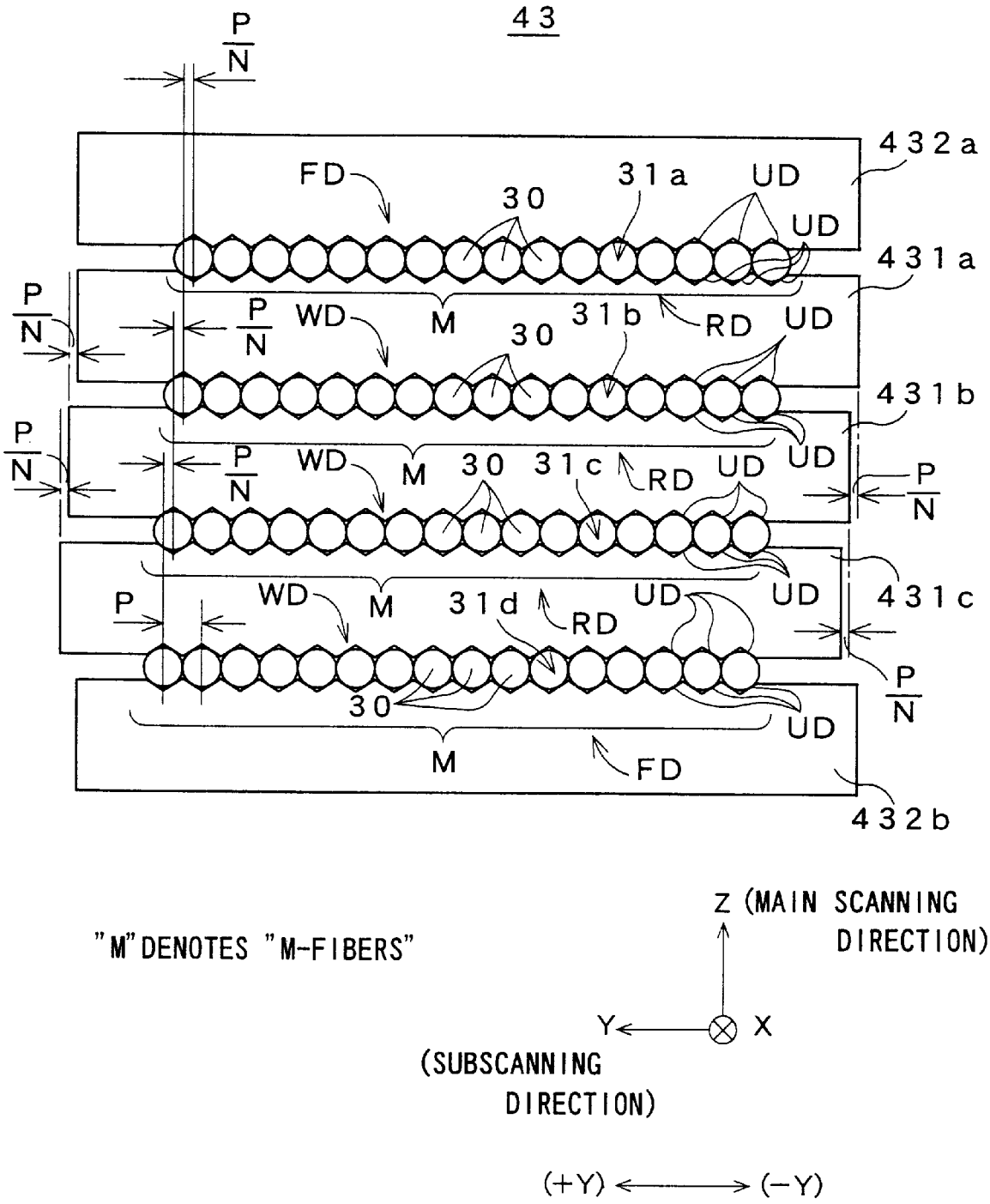

The image recorder according to a fourth preferred embodiment is identical with that of the first preferred embodiment except for an optical fiber array unit 43, whose light emitting end is shown in FIG. 5, is used in place of the optical fiber array unit 40.

The relative positions between the optical fiber rows 31*a*–31*d* in the optical fiber array unit UD are identical with those in the first and third preferred embodiments. Each of spacer substrates 431*a*, 431*b*, 431*c* and 431*d* has channels RD and WD while cover substrates 432*a* and 432*b* has a channel FD. As in the third preferred embodiment, M lines of V-shaped unit grooves UD are formed in each channel RD, WD and FD.

The feature different form the first and third preferred embodiments is that the spacer substrates 431*a*–321*d* are identical with each other in their shapes, and the cover substrates 432*a* and 432*b* are also identical with each other in their shapes. More precisely, the positions of the channels RD, WD are identical among the spacer substrates 431*a*–431*d*, that is, the distances of the channels RD, WD from the both ends of the spacer substrates 431*a*–431*d* in the direction Y are same among the spacer substrates 431*a*–431*d*. Similarly, the positions of the channels FD are identical among the cover substrates 432*a* and 432*b*, that is, the distances of the channels FD from the both ends of the cover substrates 432*a* and 432*b* in the direction Y are same among the cover substrates 432*a* and 432*b*. If the cover substrate 432*a* is turned up, the cover substrate 432*a* is identical with the other cover substrate 432*b* in their shapes, i.e., in the depth, width and position of the channel FD, and accordingly, in the positions of respective unit grooves UD.

The spacer substrates 431*a*–431*d* of the same shape are stacked while the spacer substrates 431*a*–431*d* are sequentially shifted or deviated by the length P/N in the Y-direction, and relative positions between the optical fiber rows 31*a*–31*d* are identical with those in the first and third preferred embodiments. The projections of all optical fibers 30 in the main scanning direction Z form a parallel and periodical: arrangement of M×N lined with a pitch P/N. Thus, the optical fiber array unit 43 is appropriate to a parallel scanning with M×N photo-beams having the pitch P/N. The side walls of the optical fiber array unit 43 are staggered planes because respective side edges of the substrates 431*a*–431*c*, 432*a*, 432*b* are sequentially sifted in the staggered stack.

The image recorder according to the fourth preferred embodiment is advantageous in that image recording is conducted at a high-density as in the third preferred embodiment and, in addition, the accuracy in positioning the optical fiber rows 31*a*–31*d* and the optical fibers 30 is further improved and fine scanning is attained. Furthermore, as compared with spacer substrates of different shapes and cover substrates of different shapes, the costs of fabricating optical fiber array units are decreased.

<Optical Fiber Array Unit of Fifth Embodiment>

Figure 6:
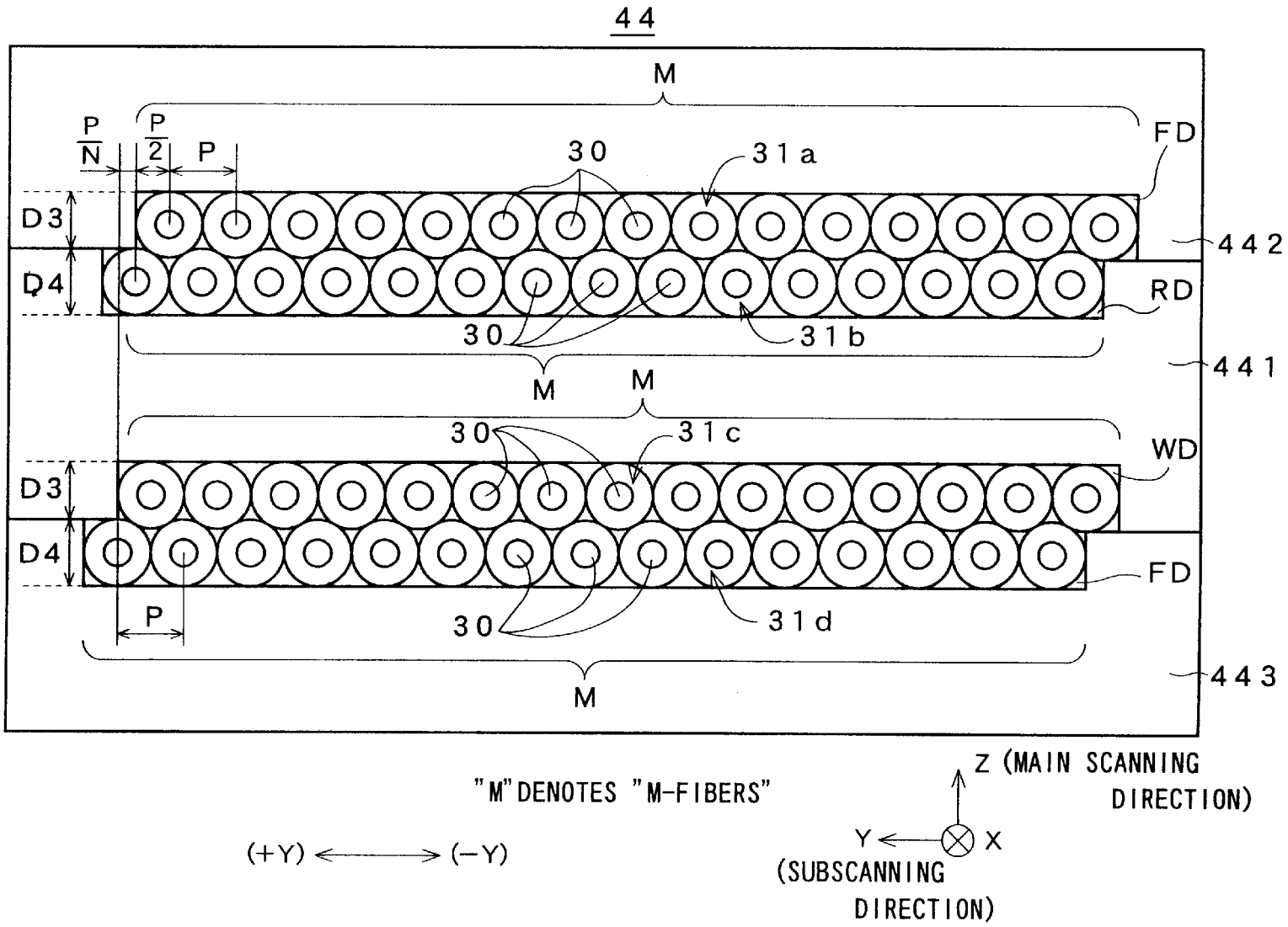

An image recorder according to a fifth preferred embodiment of the present invention is identical with the image recorder according to the first preferred embodiment except that an optical fiber array unit 43, whose light emitting end is shown in FIG. 6, is used in place of the optical fiber array unit 40.

The optical fiber array unit 43 comprises a spacer substrate 441 having a top channel RD and a bottom channel WD and cover substrates 442 and 443 each having a channel FD. The respective positions of the channels RD, WD and FD in the substrates 441, 442, 443 in the optical fiber array unit 43, i.e., the distances of the channels RD, WD and FD from the ends of the substrates in the direction Y, are identical with those in the optical fiber array unit 41 according to the second preferred embodiment. The channels RD and WD in the spacer substrate 441 are deviated by the distance P/N in the direction Y. On the other hand, the sum of the depth D3 and D4 of the channels, RD and WD in the spacer substrate 441 is slightly smaller than the value 2×P. Preferably, the sum of the depth D3 and D4 satisfies the both relations:

$$D3+D4=<(1+sqrt(3)/2)\times P$$

$$D3,\ D4>=P/2 \qquad \text{Relations-1}$$

where the symbol "sqrt( )" denotes a square root;

the symbol "=<" denotes "equal to or smaller than"; and the symbol ">=" denotes "equal to or larger than".

The Relations-1 is a preferred example defining the condition that one fiber row is substantially contained in but slightly projected from each channel RD, WD.

The respective two facing channels, i.e., i) the top channel RD in the spacer substrate 441 and the channel FD of the cover substrate 442; and ii) the bottom channel WD in the spacer substrate 441 and the channel FD of the cover substrate 443, are mutually deviated in the direction Y by the length P/2. Accordingly, respective two fiber rows (31*a* and 31*b*; 31*c* and 31*d*) contained in the facing two channels are deviated in the direction Y by the length P/2 or a half pitch. The optical fibers 30 in one fiber row are inserted between the valleys of the optical fibers in the facing fiber row and positioned with each other. That is, the adjacent two fiber row (31*a* and 31*b*; 31*c* and 31*d*) are meshed or engaged with each other whereby their positions are fixed.

In other words, the optical fiber array unit 43 is equivalent to the, modification of the optical fiber unit 41 in that the depth of respective channels are changed so as to satisfy Relation-1 and the spacer substrates 411 and 413 are removed. In general, the spacer substrates whose top channel RD is deviated from the bottom channel WD in the direction Y by the length P/2 may be removed and the optical fiber rows which were supported by the removed spacer substrates are meshed with each other to fix the respective positions.

The arrangement is such that the optical fiber rows 31*a*–31*d* are sequentially deviated by P/N in the direction Y as in the first and second preferred embodiments and the projections of all optical fibers 30 in the main scanning direction Z form a parallel and periodical arrangement of M×N lines with a pitch P/N. Thus, the optical fiber array unit 44 is appropriate to a parallel scanning with M×N photobeams having the pitch P/N and the recording density is M-times that of the image recorder having only one row of optical fibers. Further, the number of the spacer substrate(s) is decreased as compared with the first to fourth preferred embodiments and the fabrication costs are decreased.

<Optical Fiber Array Unit of Sixth Embodiment>

Figure 7:
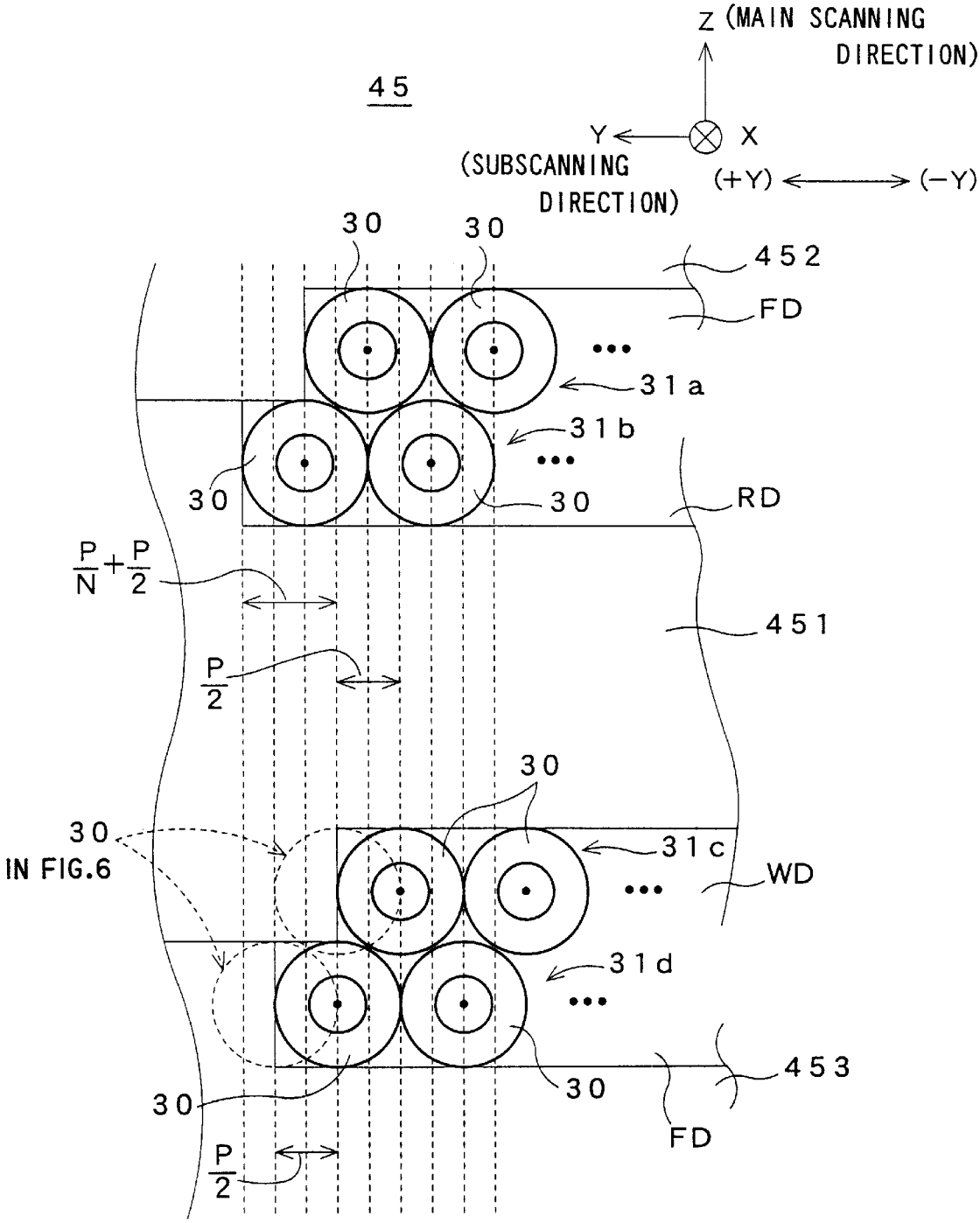

An image recorder according to a sixth preferred embodiment of the present invention is identical with the image recorder according to the first preferred embodiment except that an optical fiber array unit 45, whose light emitting end is shown in FIG. 7, is used in place of the optical fiber array unit 40.

The optical fiber array unit 45 comprises two couples of meshed fiber rows (31*a*, 31*b*) and (31*c*, 31*d*) as in the fifth preferred embodiment, and the couples of meshed optical rows (31*a*, 31*b*) and (31*c*, 31*d*) are supported by a spacer substrate 451 and a cover substrate 452, 453. However, the bottom channel WD and the top channel RD of the spacer substrate 451 are relatively deviated in the direction Y from each other by the length of (P/N+P/2), which is (¾×P) in the example illustrated. In other words, the optical fiber array unit 45 corresponds to the modification of the fifth preferred embodiment (FIG. 6), in which the channel FD of the lower cover substrate 443 and the bottom channel WD of the spacer substrate 441 are deviated together with the optical fiber rows 31*d* and 31*c* in the negative direction (−Y) by the length P/2. The number of optical fibers 30 included in each fiber row 31*a*–31*d* is the number M, and the respective width of the channels RD, WD, FD of the substrates 451–453 in the direction Y is M×P, as in the fifth preferred embodiment.

Accordingly, the optical fiber rows 31*a*–31*d* are sequentially deviated by P/N in the direction Y as in the first to fifth preferred embodiments and the projections of all optical fibers 30 in the main scanning direction Z form a parallel and periodical arrangement of M×N lines with a pitch P/N.

The optical fiber array unit 45 having the aforementioned structure is advantageous in the same points as the optical fiber array unit 44 of the fifth preferred embodiment.

<Optical Fiber Array Unit of Seventh Embodiment>

Figure 8:
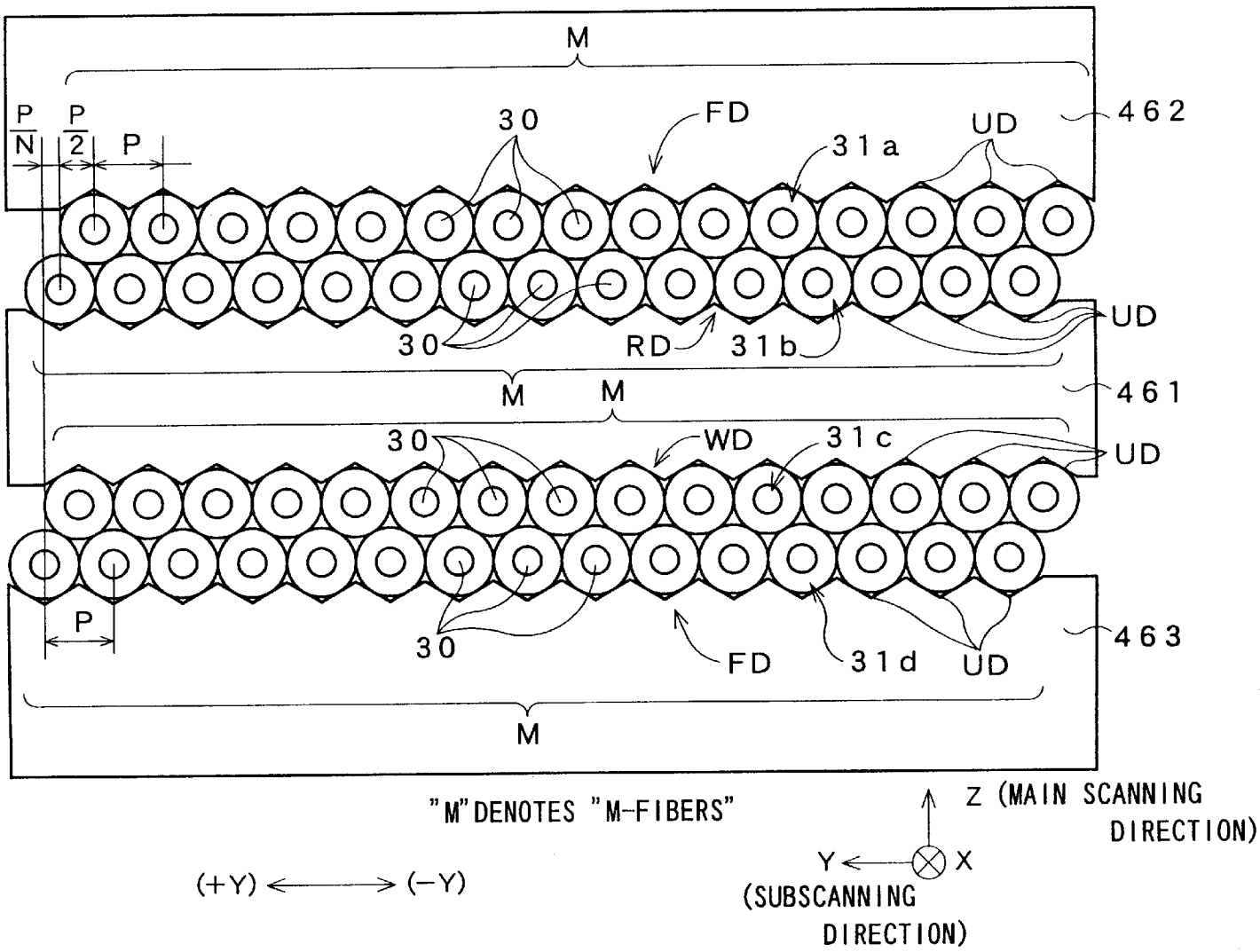
Figure 9A:
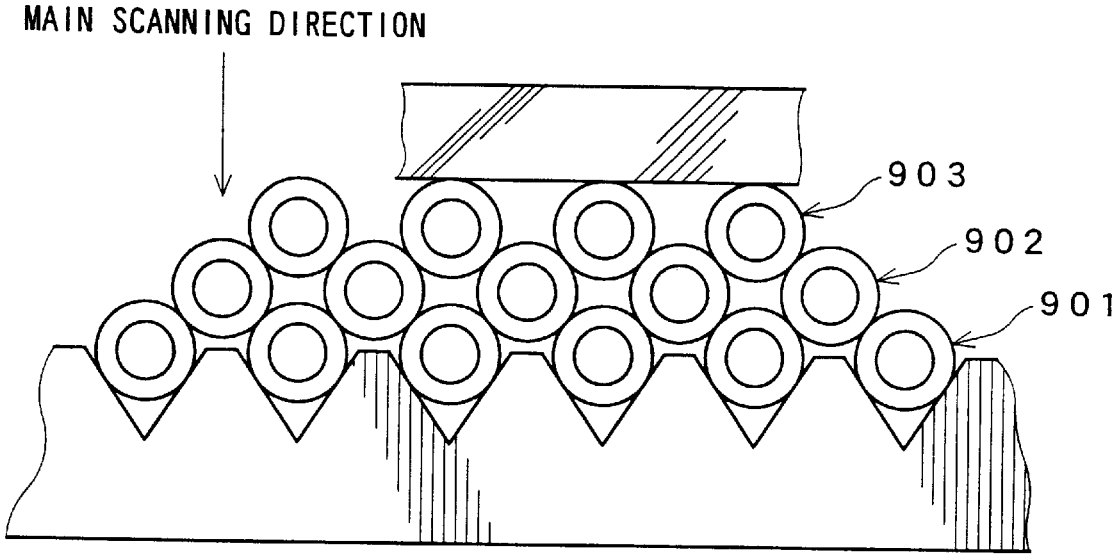
FIGS. 9A and 9B illustrate the ends of an optical fiber array unit in background arts.
Figure 9B:
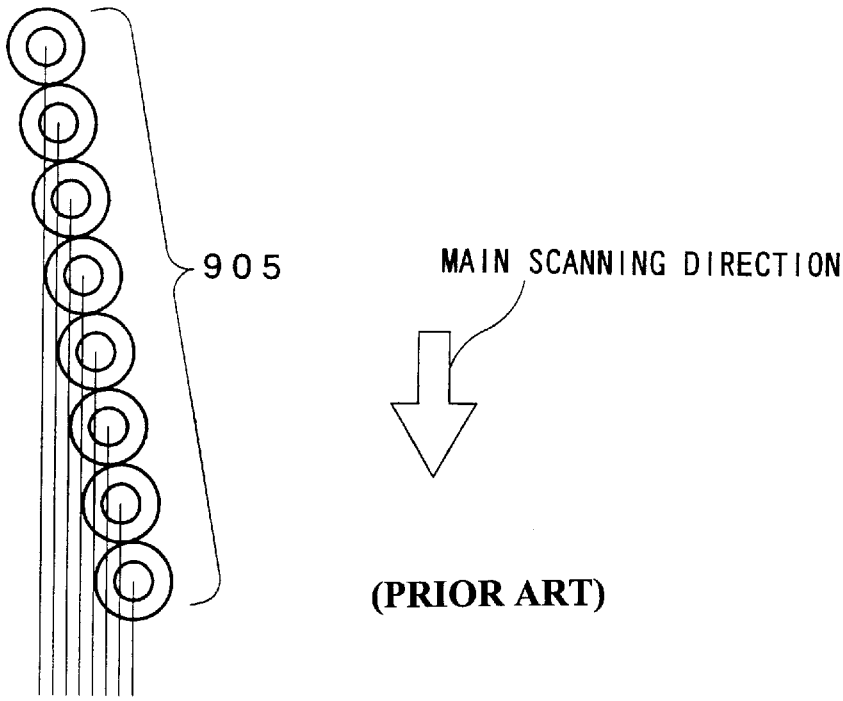
(PRIOR ART) FIG.9B

An image recorder according to a seventh preferred embodiment of the present invention is identical with the image recorder according to the first preferred embodiment except that an optical fiber array unit 46, whose light emitting end is shown in FIG. 8, is used in place of the optical fiber array unit 40.

The relative positions of the optical fiber rows 31*a*–31*d* of the optical fiber array unit 46 are identical with those in the optical fiber array unit 43 of the fifth preferred embodiment. The optical fiber array unit 46 are provided with unit grooves UD periodically formed at a same pitch P, which is the diameter of each fiber 30, to define the positions of respective optical fibers 30 and the cross sections of the unit grooves UD in the Y-Z plane are V-shaped, as in the third and forth preferred embodiments.

The optical fiber array unit 46 having the aforementioned structure has a composed merit of the third and fifth preferred embodiments, which is fine scanning at the high density and decrease of the fabrication costs.

<Other Embodiments>

In the first preferred embodiment, the spacer substrates 401–403 have the channels RD and WD at different positions sequentially deviated by the length P/N. The arrangement of the first preferred embodiment may be modified such that spacer substrates having a first same shape and cover substrate having a second same shape are prepared and are stacked at positions sequentially deviated by the length P/N as in the fourth preferred embodiment. The optical fiber rows 31*a*–31*d* are held in the spaces or tunnels defined by coupling respective two's of the channels RD, WD, FD. facing to each other, to thereby arrange the optical fiber rows 31*a*–31*d* into the form of rows sequentially deviated by the length P/N. In order to employ the cover substrates having the second same shape, the depth D1 and D2 of the facing two channels are determined such that each depth D1, D2 is substantially equal to P/2, i.e., the relation D1=D2=P/2 is substantially held.

The modification is advantageous in that the accuracy in positioning the optical fiber rows 31*a*–31*d* is increased and fine scanning is attained, similar to the fourth preferred embodiment. The costs in fabricating the image recorder are decreased as compared with the fiber array unit using substrates of different shapes.

The number N of the optical fiber rows is an integer larger than one and the number of the spacer substrates is (N−1). The number M of optical fibers in each fiber row is also an integer larger than one. The numbers of the optical fibers 30 included in respective fiber rows 31*a*–31*d* may be a same number M, as described in connection with the respective preferred embodiments. All channels have an equal width in the direction Y in the first, second, fifth and sixth preferred embodiments, while all channels have an equal number of unit grooves in the third, fourth and seventh preferred embodiments. However, the numbers of the optical fibers 30 may be different between respective fiber rows 31*a*–31*d*. In this modification, the width of respective channels in the direction Y is differentiated between different couples of two facing-channels while maintaining the equality of the width in each couple of two facing-channels, in the first, second, fifth and sixth preferred embodiments; and the numbers of unit grooves are differentiated between different couples of two facing-channels while maintaining the equality of the number of unit grooves in each couple of two facing-channels in the third, fourth and seventh preferred embodiments.

The light emitting elements included in the light sources 20 may be semiconductor lasers, high-illuminant light emitting diodes (LED's), or other light emitting elements.

The present invention is also applicable to a flat-bed type image recorder having a flat plane to be scanned as well as the drum-type image recorder in which the outer peripheral surface is scanned.

While the invention has been shown and described in detail, the foregoing description is in all aspects illustrative and not restrictive. It is therefore understood that numerous modifications and variations can be devised without departing from the scope of the invention.

What is claimed is:

1. An image recorder for scanning an objective surface with a plurality of photo-beams in a main scanning direction and a subscanning direction to record an image on said objective surface, comprising:

a light source for generating light;

an optical fiber array unit comprising a plurality of optical fibers arranged into a plurality of optical fiber rows for receiving said light and emitting a plurality of photo-beams, and a plurality of spacer substrates inserted between said plurality of said optical fiber rows, said spacer substrates having a top holding means, formed on top surface thereof, for holding ones of said optical fiber rows and bottom holding means, formed on a bottom surface thereof, for holding other ones of said optical fiber rows; and an optical system for transmitting said plurality of photo-beams from said optical fiber array unit onto said objective surface, wherein said plurality of spacer substrates are stacked such that said top holding means of one spacer substrate is aligned with said bottom holding means of another spacer substrate, wherein said top holding means are formed in parallel with said bottom holding means, and both said holding means are staggered in said subscanning direction by an integer multiple of an amount P/N, wherein P is a fiber arrangement pitch in each of the optical fiber rows and is substantially equal to a diameter of each optical fiber in each of the optical fiber rows, and N is the number of optical fiber rows included in said optical fiber array unit.

2. The image recorder in accordance with claim 1, wherein said optical fiber array unit further comprises a first cover substrate provided above a top spacer substrate among said plurality of said spacer substrates and having holding means aligned with said top holding means of said top spacer substrate, and a second cover substrate provided below a bottom spacer substrate among said plurality of said spacer substrates and having holding means aligned with said bottom holding means of said bottom spacer substrate.

3. The image recorder in accordance with claim 2, wherein said first and second cover substrate are stacked on said plurality of spacer substrates with respective side edges of said first and second cover substrates and said plurality of spacer substrates aligned.

4. The image recorder in accordance with claim 2, wherein said first and second cover, substrates have a same shape and are stacked on said plurality of spacer substrates with respective side edges of said first and second cover substrates and a number of said plurality of spacer substrates shifted from each other in said subscanning direction.

5. The image recorder in accordance with claim 1, wherein said plurality of spacer substrates have a same shape and are stacked with respective side edges shifted from each other in said subscanning direction.

6. The image recorder in accordance with claim 1, wherein said top and bottom holding means comprise a plurality of grooves arranged in said subscanning direction.

7. The image recorder in accordance with claim 6, wherein each optical fiber row is clamped by said grooves provided on adjacent two spacer substrates among said plurality of said spacer substrates.

8. A fiber array unit, comprising:

a plurality of optical fibers arranged into a plurality of optical fiber rows for receiving light and emitting a plurality of photo-beams, and a plurality of spacer substrates inserted between said plurality of said optical fiber rows, said spacer substrates having top holding means, formed on a top surface thereof, for holding ones of said optical fiber rows and bottom holding means, formed on a bottom surface thereof, for holding other ones of said optical fiber rows, wherein said plurality of spacer substrates are stacked such that said top holding means of one spacer substrate is aligned with said bottom holding means of another spacer substrate, wherein said top holding means are formed in a parallel with said bottom holding means, and both said holding means are staggered in a row direction by an integer multiple of an amount P/N, wherein P is a fiber arrangement pitch in each of the optical fiber rows and is substantially equal to a diameter of each optical fiber in each of the optical fiber rows, and N is the number of optical fiber rows included in said optical fiber array unit.

* * * * *